US009399825B2

(12) United States Patent
Fujii

(10) Patent No.: US 9,399,825 B2
(45) Date of Patent: Jul. 26, 2016

(54) WIRING BOARD AND METHOD OF MANUFACTURING WIRING BOARD

(71) Applicant: SHINKO ELECTRIC INDUSTRIES CO., LTD., Nagano (JP)

(72) Inventor: Tomoharu Fujii, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 0 days.

(21) Appl. No.: 14/469,690

(22) Filed: Aug. 27, 2014

(65) Prior Publication Data

US 2015/0077209 A1 Mar. 19, 2015

(30) Foreign Application Priority Data

Sep. 13, 2013 (JP) ..... 2013-191018

(51) Int. Cl.

| | |
|---|---|
| ***H01F 5/00*** | (2006.01) |
| ***H01F 27/28*** | (2006.01) |
| ***H01C 17/06*** | (2006.01) |
| ***C25D 5/02*** | (2006.01) |
| ***C25D 5/10*** | (2006.01) |
| ***H01F 41/04*** | (2006.01) |
| ***C25D 7/00*** | (2006.01) |
| ***H01F 17/00*** | (2006.01) |
| *C23C 18/16* | (2006.01) |

(52) U.S. Cl.

CPC *C25D 5/10* (2013.01); *C25D 5/022* (2013.01); *C25D 7/001* (2013.01); *H01F 17/0006* (2013.01); *H01F 41/046* (2013.01); *C23C 18/1653* (2013.01); *H01F 2017/0066* (2013.01); *H01F 2017/0073* (2013.01)

(58) Field of Classification Search

CPC ..... H01F 27/2804; H01F 41/046; H01F 2027/2809; H01F 2027/0066; H01F 2027/0073; H01F 17/0006; C23C 18/48; C23C 18/1653; C25D 5/02; C25D 5/10; C25D 5/022; C25D 7/001

USPC ..... 336/200, 232; 205/119; 427/97.3

See application file for complete search history.

(56) References Cited

U.S. PATENT DOCUMENTS

| | | | | |
|---|---|---|---|---|
| 5,856,898 | A * | 1/1999 | Ohashi | G11B 5/3163 360/123.39 |
| 6,365,029 | B1 * | 4/2002 | Fujita et al. | 205/118 |
| 2006/0220776 | A1 * | 10/2006 | Fujiwara | 336/200 |
| 2009/0243780 | A1 * | 10/2009 | Inoue et al. | 336/200 |
| 2011/0232948 | A1 * | 9/2011 | Sato | H05K 3/4661 174/255 |

FOREIGN PATENT DOCUMENTS

| | | |
|---|---|---|
| JP | 2001-077538 | 3/2001 |

* cited by examiner

*Primary Examiner* — Mangtin Lian
(74) *Attorney, Agent, or Firm* — IPUSA, PLLC

(57) ABSTRACT

A wiring board includes a first insulating layer; and a coil formed on the first insulating layer and including a first magnetic layer formed on the first insulating layer and formed by a plating layer, a coil portion formed on the first magnetic layer, a second insulating layer formed on the first insulating layer to cover the first magnetic layer and the coil portion, and a second magnetic layer formed on the second insulating layer and formed by a plating layer.

17 Claims, 8 Drawing Sheets

WIRING BOARD AND METHOD OF MANUFACTURING WIRING BOARD

CROSS-REFERENCE TO RELATED APPLICATION

The present application is based on and claims the benefit of priority of Japanese Priority Application No. 2013-191018 filed on Sep. 13, 2013, the entire contents of which are hereby incorporated by reference.

BACKGROUND OF THE INVENTION

1. Field of the Invention

The present invention relates to a wiring board and a method of manufacturing a wiring board.

2. Description of the Related Art

Conventionally, a patterned coil provided in a print board is known where a spiral-shaped coil is formed by forming patterns for the coil in a build-up multilayered board and connecting the patterns for the coil by build-up vias.

However, as the conventional patterned coil has a large size as a component, it is difficult to mount the conventional patterned coil on a package of a processor such as a Central Processing Unit (CPU), for example.

PATENT DOCUMENT

[Patent Document 1] Japanese Laid-open Patent Publication No. 2001-077538

SUMMARY OF THE INVENTION

The present invention is made in light of the above problems, and provides a wiring board or the like including a small size coil.

According to an embodiment, there is provided a wiring board including: a first insulating layer; and a coil formed on the first insulating layer and including a first magnetic layer formed on the first insulating layer and formed by a plating layer, a coil portion formed on the first magnetic layer, a second insulating layer formed on the first insulating layer to cover the first magnetic layer and the coil portion, and a second magnetic layer formed on the second insulating layer and formed by a plating layer.

According to another embodiment, there is provided a method of manufacturing a wiring board, including: forming a coil on a first insulating layer that includes forming a first magnetic layer on the first insulating layer by a plating process, forming a coil portion on the first magnetic layer, forming a second insulating layer on the first insulating layer to cover the coil portion, and forming a second magnetic layer on the second insulating layer by a plating process.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1A:
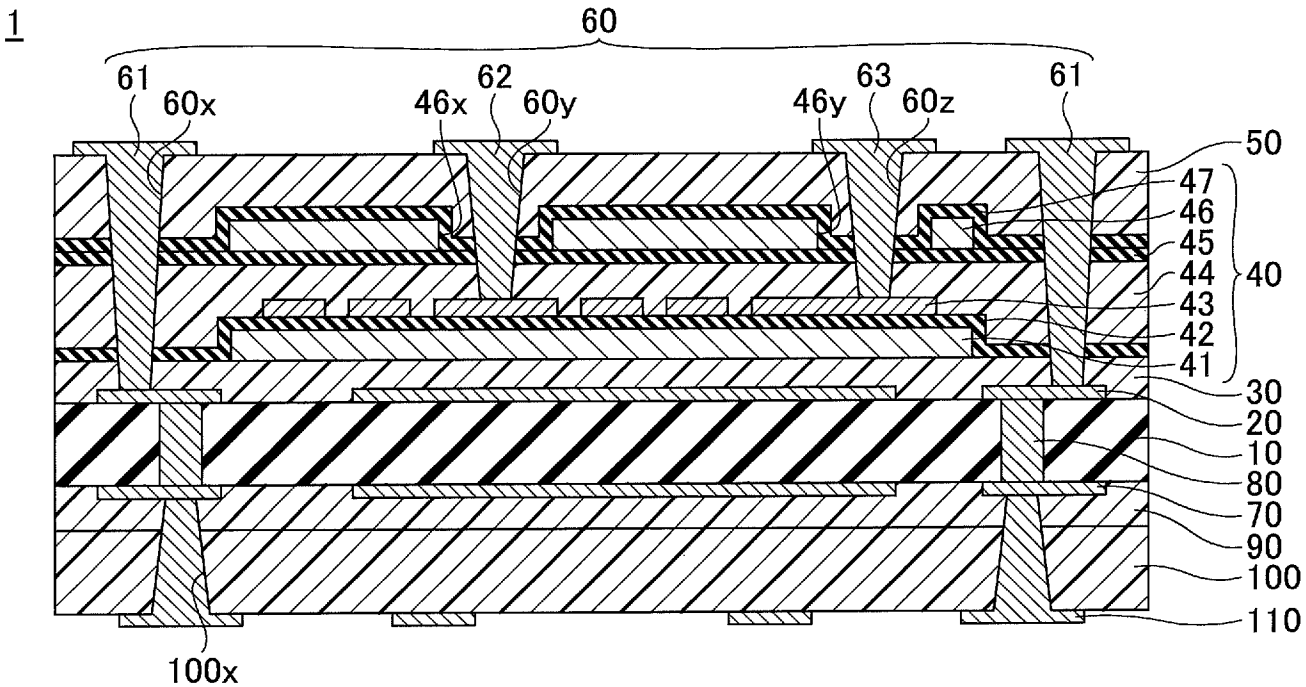
FIG. 1A and FIG. 1B are views illustrating an example of a wiring board of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

(First Embodiment)

(Structure of Wiring Board of First Embodiment)

Figure 1B:
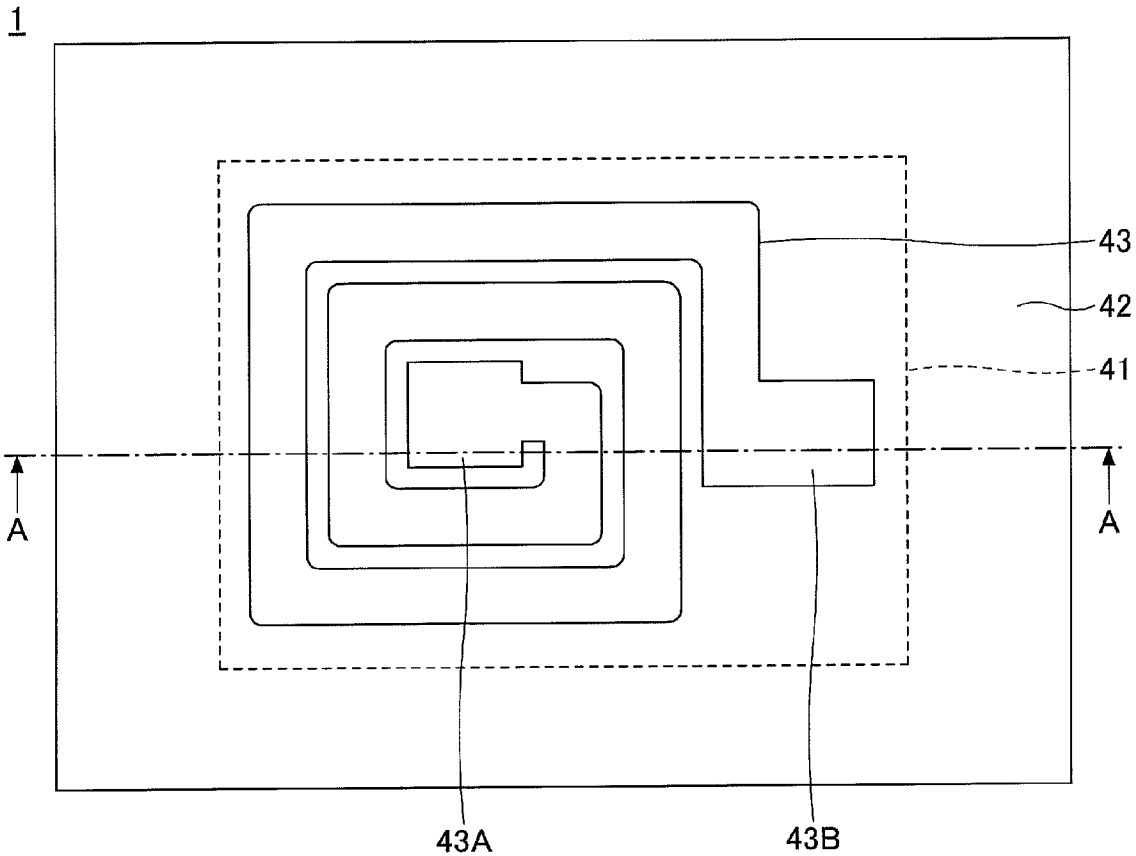

The wiring board of the first embodiment is explained. FIG. 1A and FIG. 1B are views illustrating an example of a wiring board 1 of the first embodiment. FIG. 1B is a plan view, and FIG. 1A is a cross-sectional view taken along an A-A line in FIG. 1B. In FIG. 1B, layers that are positioned higher than an insulating layer 44 are not illustrated.

With reference to FIG. 1A and FIG. 1B, the wiring board 1 includes a core substrate 10, a wiring layer 20, an insulating layer 30, a coil (an inductor) 40, an insulating layer 50, a wiring layer 60, a wiring layer 70, through vias 80, an insulating layer 90, an insulating layer 100 and a wiring layer 110.

In this embodiment, an insulating layer 50 side is referred to as an upper side or one side, and an insulating layer 100 side is referred to as a lower side or the other side, for the purpose of explanation. Further, a surface of each components at the insulating layer 50 side is referred to as an upper surface or one side, and a surface at the insulating layer 100 side is referred to as a lower surface or the other surface. However, the wiring board 1 may be used in an opposite direction or may be used at an arbitrarily angle. Further, in this embodiment, "in a plan view" means that an object is seen in a direction that is normal to one surface of the core substrate 10, and a "plan shape" means a shape of an object seen in the direction that is normal to the one surface of the core substrate 10.

The core substrate 10 is a substrate obtained by impregnating a glass cloth base in epoxy resin, for example. The thickness of the core substrate 10 may be about 0.2 to 1.6 mm, for example. The wiring layer 20 is formed on one surface of the core substrate 10 and the wiring layer 70 is formed on another surface of the core substrate 10. The wiring layer 20 and the wiring layer 70 are electrically connected via the through vias 80 that penetrate the core substrate 10. For the material of the wiring layer 20, the wiring layer 70 and the through vias 80, copper (Cu) or the like may be used, for example. The thickness of each of the wiring layers 20 and 70 may be about 10 to 20 μm, for example.

The insulating layer 30 is formed on the one surface of the core substrate 10 to cover the wiring layer 20. For the material of the insulating layer 30, a material including insulating resin such as thermosetting epoxy-based resin, polyimide-based resin or the like as a main component (a resin film, for example) may be used, for example. The insulating layer 30 may include filler such as silica ($SiO_2$) or the like. The thickness of the insulating layer 30 may be about 15 to 35 μm, for example. The insulating layer 30 is a typical example of a first insulating layer.

The coil 40 is formed at an upper surface of the insulating layer 30. In other words, the coil 40 is included in the wiring board 1 to be inserted between the insulating layer 30 and the insulating layer 50. The coil 40 includes a first magnetic layer 41, an insulating layer 42, a coil portion 43, an insulating layer 44, an insulating layer 45, a second magnetic layer 46 and an insulating layer 47.

The first magnetic layer 41 is formed on the upper surface of the insulating layer 30. As illustrated in FIG. 1B, the first magnetic layer 41 is patterned to have a substantially rectangular shape in a plan view. The first magnetic layer 41 is formed to be smaller than the insulating layer 30 but larger than the coil portion 43 so that to overlap the entirety of the coil portion 43, in a plan view. The thickness of the first magnetic layer 41 may be about 10 μm, for example. The size of the first magnetic layer 41 may be about 0.85 mm (in a longitudinal direction: an upper-lower direction in FIG. 1B)× about 2 mm (in a lateral direction: a left-right direction in FIG. 1B), in a plan view.

For the material of the first magnetic layer 41, alloy of zinc and ferrite (Zn—Fe) may be used, for example. In this case, the first magnetic layer 41 may be formed by an alloy plating layer of zinc and ferrite, for example. As the alloy of zinc and ferrite (Zn—Fe) formed by a plating process has a relatively high resistance value (about 100Ω), it is preferable to use for the first magnetic layer 41 on which the coil portion 43 is formed. The thickness of the first magnetic layer 41 may be about 5 to 10 μm, for example.

The insulating layer 42 is formed to continuously cover the upper surface of the insulating layer 30 and the upper surface and the side surface of the first magnetic layer 41. For the material of the insulating layer 42, insulating resin such as polyimide-based resin, epoxy-based resin or the like may be used, for example. The thickness of the insulating layer 42 may be about 3 to 10 μm, for example.

The coil portion 43 is formed on the first magnetic layer 41 via the insulating layer 42. The coil portion 43 is a planar coil that is wound in a spiral rectangular shape in a plan view. The coil portion 43 is provided with one end 43A and another end 43B. The coil portion 43 may be referred to as a spiral coil (inductor) as well. For the material of the coil portion 43, copper (Cu) or the like may be used. In this case, the coil portion 43 may be formed by a copper plating layer, for example. The thickness of the coil portion 43 may be about 10 to 20 μm, for example. The line/space of the coil portion 43 may be line/space=120 μm/20 μm, for example.

In this embodiment, the coil portion 43 is wound about 2.5 times in a clockwise direction from the one end 43A to the other end 43B to have a rectangular shape. As such, in this embodiment, the coil portion 43 whose winding number is 2.5 is exemplified. However, the winding number of the coil portion 43 may be determined based on purpose of use of the coil portion 43. The winding number of the coil portion 43 may be as large as about 100, for example.

The insulating layer 44 is formed on the insulating layer 30 to cover the first magnetic layer 41, the insulating layer 42 and the coil portion 43. The insulating layer 44 absorbs convexo-concave generated by the first magnetic layer 41, the insulating layer 42 and the coil portion 43, and the upper surface of the insulating layer 44 is a flat surface. Here, the flat surface means a surface that the difference between the highest (thickest) portion and the lowest (thinnest) portion of the upper surface of the insulating layer 44, with respect to a surface of the insulating layer 42 at which the coil portion 43 is formed as a base, is less than or equal to 1 μm.

The material for the insulating layer 44 may be the same as that of the insulating layer 30, for example. The thickness of the insulating layer 44 may be about 40 to 55 μm, for example. The insulating layer 44 may include filler such as silica ($SiO_2$) or the like. The insulating layer 44 may include magnetic filler (ferrite based filler or the like, for example) so that the inductance of the coil 40 can be improved. The insulating layer 44 is a typical example of a second insulating layer.

The insulating layer 45 is formed on an upper surface of the insulating layer 44. The material and the thickness of the insulating layer 45 may be the same as those of the insulating layer 42, for example. The upper surface of the insulating layer 45 is also a flat surface. By forming the insulating layer 45 on the insulating layer 44, the upper surface of the insulating layer 45 can be more even than the upper surface of the insulating layer 44. Thus, by forming the second magnetic layer 46 on the upper surface of the insulating layer 44 via the insulating layer 45, stable crystal orientation can be easily obtained in the second magnetic layer 46. Further, the thickness of the second magnetic layer 46 can be easily controlled and the thickness of the second magnetic layer 46 can be made more even. The insulating layer 45 is a typical example of a third insulating layer.

The second magnetic layer 46 is formed on the coil portion 43 at a level higher than the insulating layer 44. Specifically, the second magnetic layer 46 is patterned in a substantially rectangular shape and is formed on the upper surface of the insulating layer 45 at a position substantially overlapping the first magnetic layer 41 in a plan view. In other words, the coil portion 43 is inserted between the first magnetic layer 41 and the second magnetic layer 46 from upper and lower directions. However, different from the first magnetic layer 41, the second magnetic layer 46 is provided with open portions 46*x* and 46*y*. The open portion 46*x* is formed to substantially overlap the one end 43A of the coil portion 43 in a plan view. The open portion 46*y* is formed to substantially overlap the other end 43B of the coil portion 43 in a plan view. The plan shapes of the open portions 46*x* and 46*y* may be a rectangular shape, a circular shape or the like, for example. The material, the thickness and the method of manufacturing of the second magnetic layer 46 may be the same as those of the first magnetic layer 41, for example.

The entirety of the coil portion 43 other than the one end 43A and the other end 43B is covered by the second magnetic layer 46. Although a part of the other end 43B of the coil portion 43 is covered by the second magnetic layer 46 as well in this embodiment, the part is not necessarily covered by the second magnetic layer 46.

The thickness of the second magnetic layer 46 may be about 10 μm, for example. The size of the second magnetic layer 46 (including the open portions 46*x* and 46*y*) may be about 0.85 mm (in a longitudinal direction: the upper-lower direction in FIG. 1B)×about 2 mm (in a lateral direction: the left-right direction in FIG. 1B), in a plan view. Here, when the line/space of the coil portion 43 is line/space=120 μm/20 μm, the winding number of the coil portion 43 is 2.5, and the first magnetic layer 41 and the second magnetic layer 46 have the above described sizes, the inductance of the coil 40 may be about 7 nH.

The insulating layer 47 is formed to continuously cover the upper surface of the insulating layer 45 and the upper surface and the side surface of the second magnetic layer 46, including inner walls of the open portions 46*x* and 46*y*. The material and the thickness of the insulating layer 47 may be the same as those of the insulating layer 42, for example. As a micro convexo-concave is formed on the surface of the insulating layer 47, adhesion between the second magnetic layer 46 and the insulating layer 50 can be improved.

The insulating layer 50 is formed on the coil 40. Specifically, the insulating layer 50 is formed on the insulating layer 47 that composes the coil 40. The material and the thickness of the insulating layer 50 may be the same as those of the insulating layer 30, for example. The insulating layer 50 may include a filler such as silica ($SiO_2$) or the like. The insulating layer 50 absorbs the convexo-concave generated by the second magnetic layer 46 and the insulating layer 47 so that the upper surface of the insulating layer 50 is a flat surface.

The wiring layer 60 includes wirings 61, 62 and 63. The insulating layer 30, the insulating layer 42, the insulating layer 44, the insulating layer 45, the insulating layer 47 and the insulating layer 50 are provided with via holes 60*x* that continuously penetrate these layers to expose an upper surface of the wiring layer 20. Each of the wirings 61 includes a via wiring filled in the via hole 60*x* and a wiring pattern formed on an upper surface of the insulating layer 50. The wiring 61 is electrically connected to the wiring layer 20 that is exposed at a bottom portion of the via hole 60*x*. Each of the via holes 60*x* is a concave portion having an inverse cone trapezoid shape where the diameter of an open portion at the insulating layer 50 side is larger than the diameter of a bottom surface formed at the upper surface of the wiring layer 20.

The insulating layer 44, the insulating layer 45, the insulating layer 47 and the insulating layer 50 are provided with a via hole 60*y* that continuously penetrates these layers to expose the upper surface of the one end 43A of the coil portion 43. The wiring 62 includes a via wiring filled in the via hole 60*y* and a wiring pattern formed at the upper surface of the insulating layer 50. The wiring 62 is electrically connected to the one end 43A of the coil portion 43 that is exposed at a bottom portion of the via hole 60*y*. This means that the wiring pattern of the wiring 62 functions as a terminal to be connected to the one end 43A of the coil portion 43. The via hole 60*y* is a concave portion having an inverse cone trapezoid shape where the diameter of the open portion at the insulating layer 50 side is larger than the diameter of a bottom surface formed at the upper surface of the one end 43A of the coil portion 43.

The insulating layer 44, the insulating layer 45, the insulating layer 47 and the insulating layer 50 are provided with a via hole 60*z* that continuously penetrates these layers to expose the upper surface of the other end 43B of the coil portion 43. The wiring 63 includes a via wiring filled in the via hole 60*z* and a wiring pattern formed at the upper surface of the insulating layer 50. The wiring 63 is electrically connected to the other end 43B of the coil portion 43 that is exposed at a bottom portion of the via hole 60*z*. This means that the wiring pattern of the wiring 63 functions as a terminal to be connected to the other end 43B of the coil portion 43. The via hole 60*z* is a concave portion having an inverse cone trapezoid shape where the diameter of an open portion at the insulating layer 50 side is larger than the diameter of a bottom surface of an open portion formed at the upper surface of the other end 43B of the coil portion 43.

For the material of the wiring layer 60, copper (Cu) or the like may be used, for example. The thickness of the wiring pattern of each of the wirings 61, 62 and 63 that compose the wiring layer 60 may be about 10 to 20 μm, for example.

The insulating layer 90 is formed on the other surface of the core substrate 10 to cover the wiring layer 70. The material and the thickness of the insulating layer 90 may be the same as those of the insulating layer 30, for example. The insulating layer 100 is formed on a lower surface of the insulating layer 90. The material and the thickness of the insulating layer 100 may be the same as those of the insulating layer 44, for example. The insulating layer 100 may include filler such as silica ($SiO_2$) or the like.

The insulating layers 90 and 100 are provided with via holes 100*x* that continuously penetrate these layers to expose a lower surface of the wiring layer 70. The wiring layer 110 includes via wirings filled in each of the via holes 100*x* and wiring patterns formed at the lower surface of the insulating layer 100. The wiring layer 110 is electrically connected to the wiring layer 70 that is exposed at bottom portions of the via holes 100*x*. Each of the via holes 100*x* is a concave portion having a cone trapezoid shape where the diameter of an open portion at the insulating layer 100 side is larger than the diameter of a bottom surface formed at the lower surface of the wiring layer 70.

In the wiring board 1, a CPU and a capacitor may be mounted on the insulating layer 50. In this case, the coil 40 of the wiring board 1 is electrically connected to the IC and the switching element included in the CPU and the capacitor to form a power supply circuit. As such, the power supply circuit can be placed near the CPU so that the power can be effectively supplied.

(Method of Manufacturing Wiring Board of First Embodiment)

Next, a method of manufacturing the wiring board 1 of the first embodiment is explained. FIG. 2A to FIG. 5C are cross-sectional views illustrating the method of manufacturing the wiring board 1 of the first embodiment.

Figure 2A:
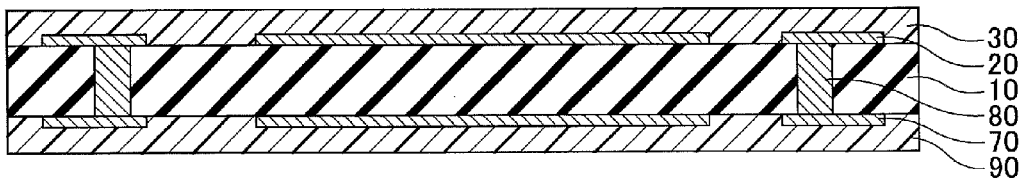
FIG. 2A to FIG. 2D are views illustrating an example of manufacturing steps of the wiring board of the first embodiment.

First, in a step illustrated in FIG. 2A, the core substrate 10 is prepared in which the wiring layer 20 is formed on the one surface and the wiring layer 70 is formed on the other surface and the wiring layer 20 and the wiring layer 70 are electrically connected with each other via the through vias 80. Then, the insulating layer 30 is stacked on the one surface of the core substrate 10 to cover the wiring layer 20. Further, the insulating layer 90 is stacked on the other surface of the core substrate 10 to cover the wiring layer 70. The insulating layers 30 and 90 may be formed on the one surface and the other surface of the core substrate 10 by heating and pressing semi-cured resin films by a vacuum laminator, for example. For the resin films, resin films such as epoxy-based resin films, polyimide-based resin films or the like may be used, for example.

Figure 2B:
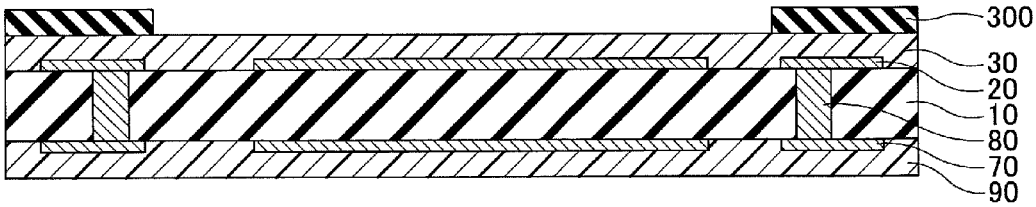

Next, in a step illustrated in FIG. 2B, a frame-like mask 300 is formed at an outer edge portion of the upper surface of the insulating layer 30, for example. The mask 300 may be farmed by coating a photosensitive resist material on the upper surface of the insulating layer 30 and curing the photosensitive resist material by a photolithography process, for example.

Figure 2C:
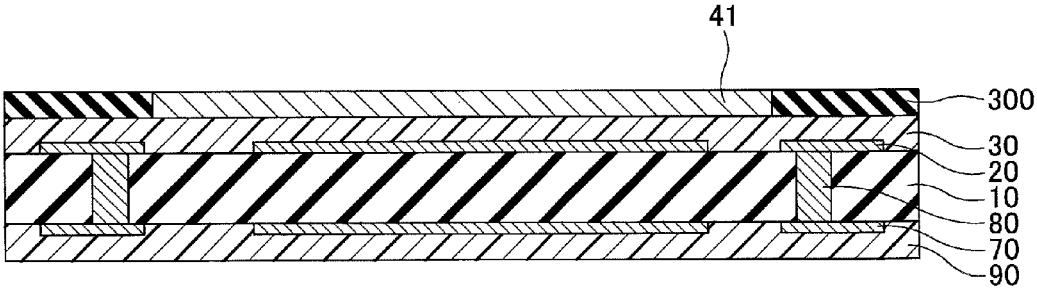

Next, in a step illustrated in FIG. 2C, the first magnetic layer 41 is formed at a portion on the upper surface of the insulating layer 30 where the mask 300 is not formed. The first magnetic layer 41 may be formed by a spray plating process, for example. The spray plating process may be performed using Zn—Fe plating solution, for example. The thickness of the first magnetic layer 41 may be about 10 μm, for example. The size of the first magnetic layer 41 may be about 0.85 mm (in a longitudinal direction: a penetrating direction in FIG. 2C)×about 2 mm (in a lateral direction: a left-right direction in FIG. 2C), in a plan view.

The composition of the Zn—Fe alloy capable of being used as the first magnetic layer 41 may be $Zn_{0.36}$—$Fe_{2.54}O_4$ for example. As the first magnetic layer 41, alloy of ferrite (Fe) and nickel (Ni), cobalt (Co), beryllium (Be), magnesium (Mg), calcium (Ca), strontium (Sr), barium (Ba), manganese (Mn) or the like may be used instead of the Zn—Fe alloy, for example.

Figure 2D:
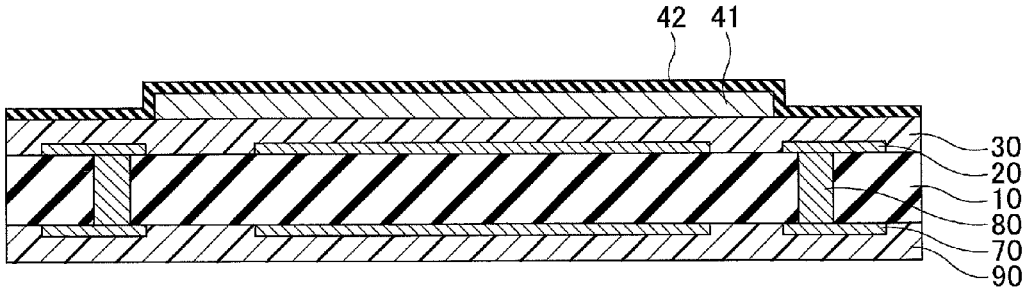

Next, in a step illustrated in FIG. 2D, after removing the mask 300 illustrated in FIG. 2C, the insulating layer 42 is formed to continuously cover the outer edge portion of the upper surface of the insulating layer 30 and the upper surface and the side surface of the first magnetic layer 41.

The mask 300 may be removed by an etching process using peeling solution, for example. The insulating layer 42 may be formed by coating varnish insulating resin such as polyimide-based resin, epoxy-based resin or the like by a spin coating method, for example. The thickness of the insulating layer 42 may be about 3 to 10 μm, for example. As a micro convexo-concave is formed at the surface of the insulating layer 42, adhesion between the first magnetic layer 41 and the coil portion 43 can be improved.

Figure 3A:
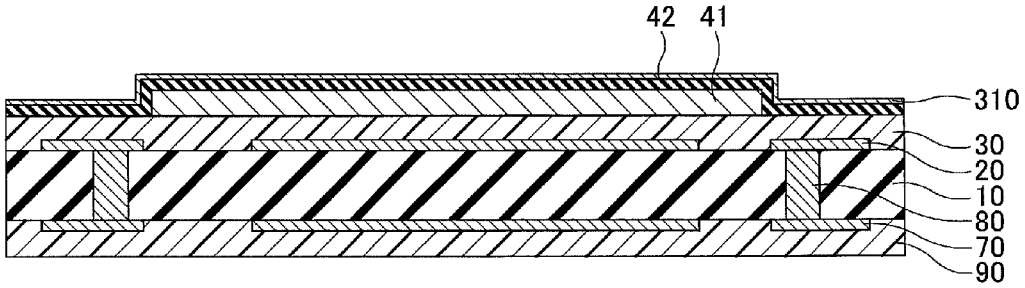
FIG. 3A to FIG. 3D are views illustrating an example of manufacturing steps of the wiring board of the first embodiment.

Next, in a step illustrated in FIG. 3A, a seed layer 310 is formed on the upper surface of the insulating layer 42. The seed layer 310 functions as a seed in an electrolytic plating process to form the coil portion 43 on the upper surface thereof. The seed layer 310 may be formed by sputtering copper, for example. The seed layer 310 may be a copper thin film formed by an electroless plating process. The thickness of the seed layer 310 may be about 0.5 to 0.8 μm, for example.

Figure 3B:
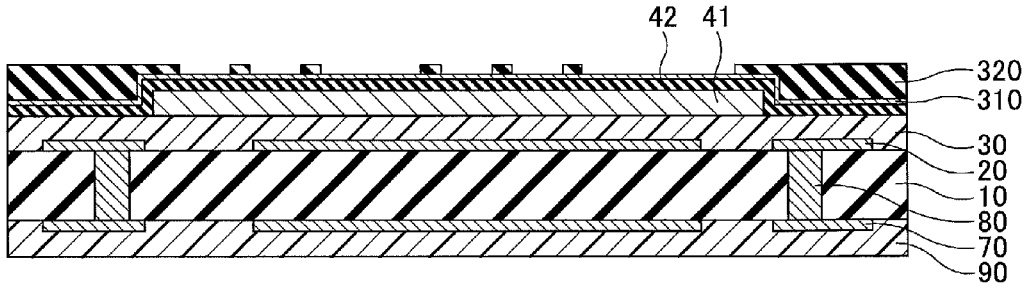

Next, in a step illustrated in FIG. 3B, a mask 320 is formed on the upper surface of the seed layer 310 using a photosensitive resist material. The mask 320 may be formed by coating the photosensitive resist material on the upper surface of the seed layer 310, and curing the photosensitive resist material by a photolithography process, for example. The mask 320 is used when forming the coil portion 43 by an electrolytic plating process in the following steps. Thus, the mask 320 may be patterned to form the coil portion 43 (see FIG. 1B).

Figure 3C:
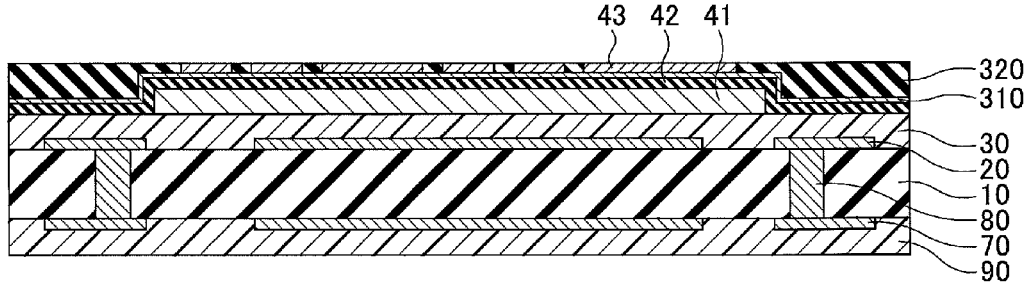

Next, in a step illustrated in FIG. 3C, the coil portion 43 made of copper is formed by the electrolytic plating process, for example. The electrolytic plating process may be performed while power feeding the seed layer 310. The thickness of the coil portion 43 may be about 10 to 20 μm, for example. For example, the seed layer 310 may be formed at a portion that is not remained in the final product wiring board 1 (a portion to be removed) and the seed layer 310 formed at this portion may be used as a power supply pattern.

Figure 3D:
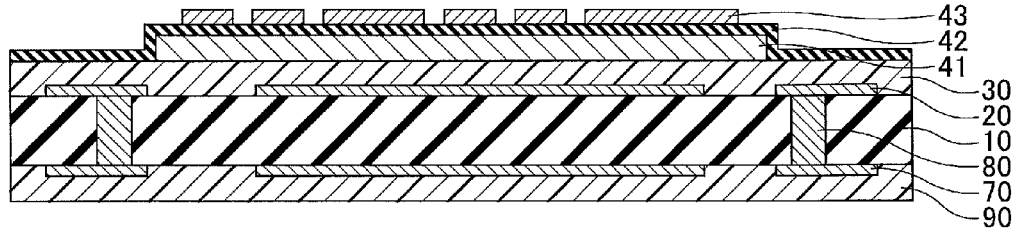

Next, in a step illustrated in FIG. 3D, the mask 320 illustrated in FIG. 3C is removed to expose the seed layer 310, and then, a portion of the seed layer 310 exposed from the coil portion 43 is also removed. The mask 320 may be removed by an etching process using peeling solution. The seed layer 310 may be removed by bias sputtering, for example. In the bias sputtering, the portion of the seed layer 310 that is formed between the coil portion 43 and the insulating layer 42 is not removed as such a part exists integrally with the coil portion 43. The portion of the seed layer 310 that exists integrally with the coil portion 43 it not illustrated in the drawings after FIG. 3D.

The line/space of the coil portion 43 thus obtained is line/space=120 μm/20 μm and the winding number is 2.5. The seed layer 310 may be removed by wet etching instead of bias sputtering.

Figure 4A:
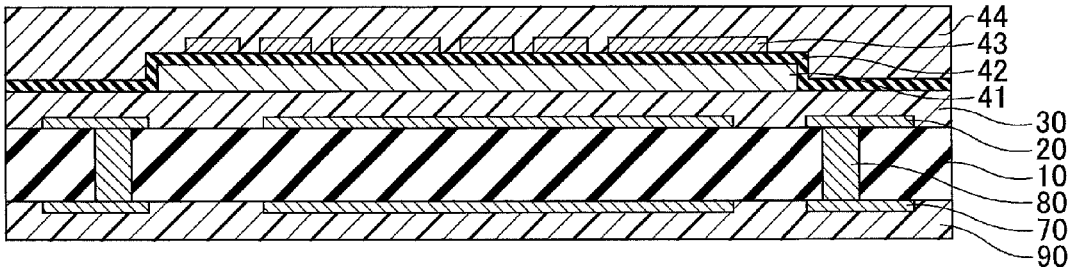
FIG. 4A to FIG. 4C are views illustrating an example of manufacturing steps of the wiring board of the first embodiment.

Next, in a step illustrated in FIG. 4A, the insulating layer 44 is formed on the insulating layer 42 to cover the coil portion 43. The insulating layer 44 may be formed by using a vacuum laminator, for example. Specifically, a semi-cured resin film is placed to cover the coil portion 43 in vacuum atmosphere, and the semi-cured resin film is pressed toward the insulating layer 30 side while being heated, for example. With this, the insulating layer 44 whose upper surface is a flat surface is formed by filling spaces between the winding wires of the coil portion 43. This means that the insulating layer 44 can absorb the convexo-concave generated by the first magnetic layer 41, the insulating layer 42 and the coil portion 43 so that the upper surface of the insulating layer 44 can be a flat surface.

For the resin film, a resin film such as an epoxy-based resin film, a polyimide-based resin film or the like may be used, for example. The thickness of the insulating layer 44 may be about 40 to 55 μm, for example. The insulating layer 44 may include filler such as silica ($SiO_2$) or the like. The insulating layer 44 may include magnetic filler (ferrite based filler or the like, for example) so that the inductance of the coil 40 can be improved.

Figure 4B:
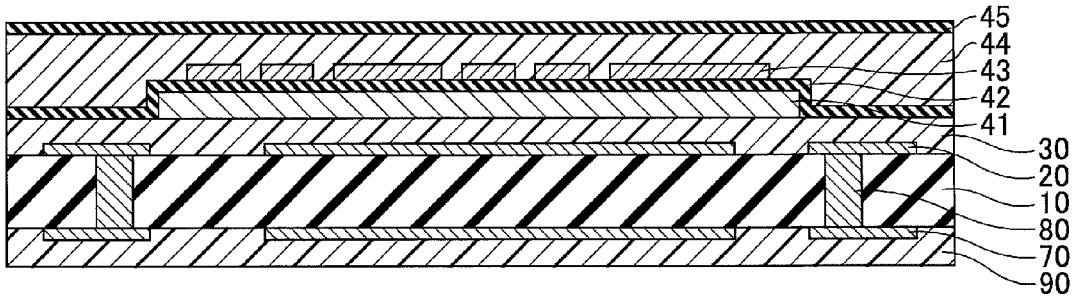

Next, in a step illustrated in FIG. 4B, the insulating layer 45 is formed on the upper surface of the insulating layer 44 to cover the insulating layer 44. Similar to the insulating layer 42, the insulating layer 45 may be formed by coating varnish insulating resin such as polyimide-based resin, epoxy-based resin or the like by a spin coating method, for example. The thickness of the insulating layer 45 may be about 3 to 10 μm, for example.

Figure 4C:
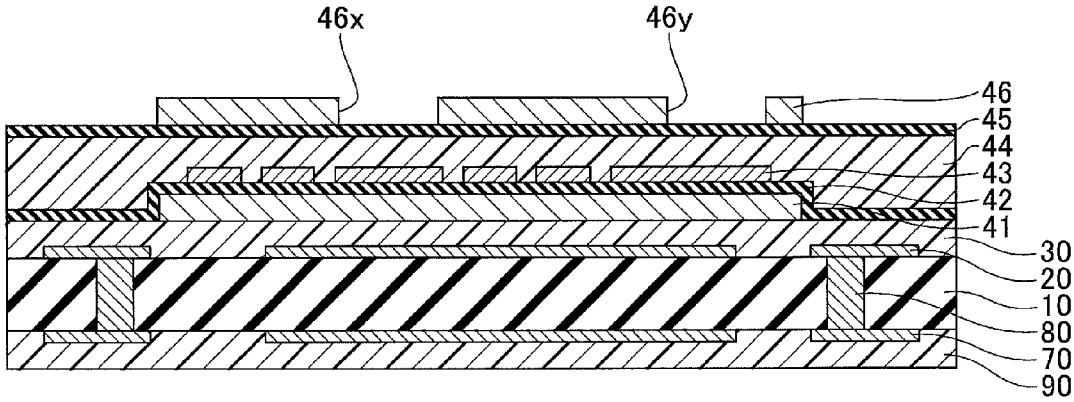

Next, in a step illustrated in FIG. 4C, the second magnetic layer 46 provided with the open portions 46*x* and 46*y* is formed on the upper surface of the insulating layer 45 at a position substantially overlapping the first magnetic layer 41 in a plan view. The open portion 46*x* is formed at a position substantially overlapping the one end 43A of the coil portion 43 in a plan view. The open portion 46*y* is formed at a position substantially overlapping the other end 43B of the coil portion 43 in a plan view. The second magnetic layer 46 may be formed, similar to the step illustrated in FIG. 2B, by forming a mask having a predetermined shape on the upper surface of the insulating layer 45. Then, similar to the step illustrated in FIG. 2C, the second magnetic layer 46 is formed at a portion of the upper surface of the insulating layer 45 where the mask is not formed by a spray plating process, for example. Thereafter, the mask is removed.

Figure 5A:
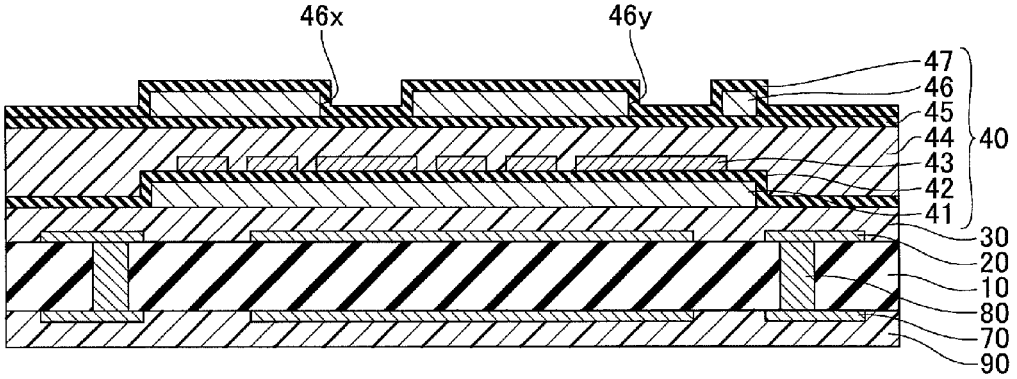
FIG. 5A to FIG. 5C are views illustrating an example of manufacturing steps of the wiring board of the first embodiment.

Next, in a step illustrated in FIG. 5A, similar to the step illustrated in FIG. 2D, the insulating layer 47 is formed to continuously cover the outer edge portion of the upper surface of the insulating layer 45 and the upper surface and the side surface of the second magnetic layer 46 including the inner walls of the open portions 46*x* and 46*y*. Similar to the insulating layer 42, the insulating layer 47 may be formed by coating varnish insulating resin such as polyimide-based resin, epoxy-based resin or the like by a spin coating method, for example. The thickness of the insulating layer 47 may be about 3 to 10 μm, for example. By the step illustrated in FIG. 5A, the coil 40 is formed on the upper surface of the insulating layer 30.

Figure 5B:
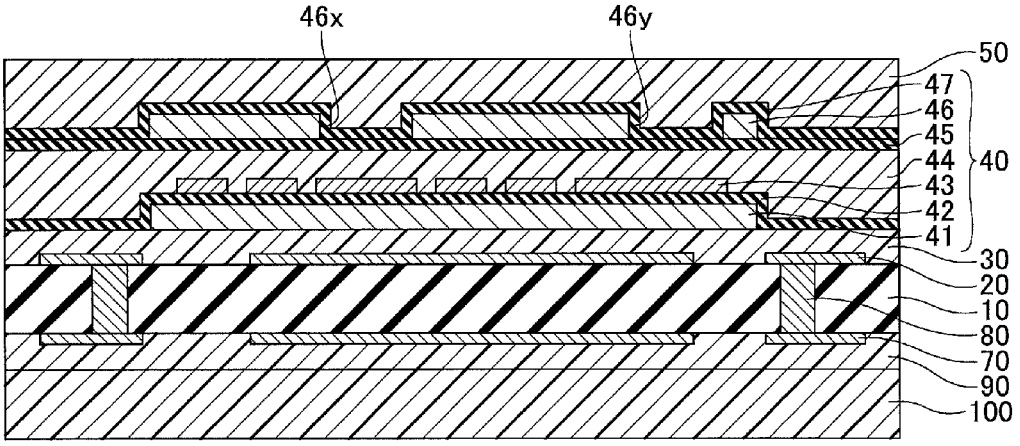

Next, in a step illustrated in FIG. 5B, the insulating layer 50 is formed on the upper surface of the insulating layer 47. Further, the insulating layer 100 is formed on the lower surface of the insulating layer 90. The method of manufacturing, the material and the thickness of the insulating layers 50 and 100 may be the same as those of the insulating layer 44, for example.

Figure 5C:
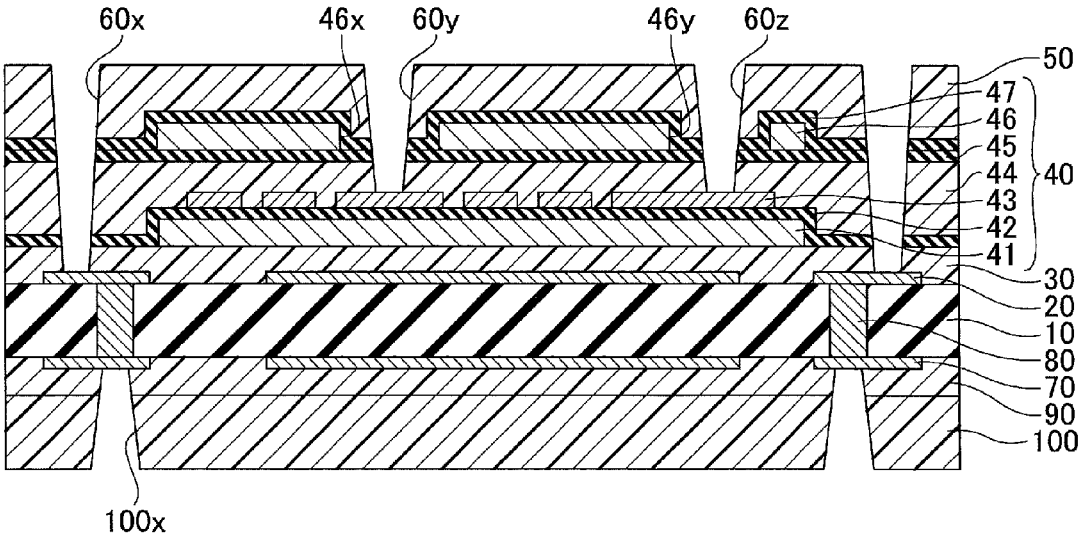

Next, in a step illustrated in FIG. 5C, the via holes 60*x* are formed that continuously penetrate the insulating layer 30, the insulating layer 42, the insulating layer 44, the insulating layer 45, the insulating layer 47 and the insulating layer 50 to expose the upper surface of the wiring layer 20. Further, the via hole 60*y* is formed that continuously penetrates the insulating layer 44, the insulating layer 45, the insulating layer 47 and the insulating layer 50 to expose the upper surface of the one end 43A of the coil portion 43. Further, the via hole 60*z* is formed that continuously penetrates the insulating layer 44, the insulating layer 45, the insulating layer 47 and the insulating layer 50 to expose the upper surface of the other end 43B of the coil portion 43. Further, the via holes 100*x* are formed that continuously penetrate the insulating layers 90 and 100 to expose the lower surface of the wiring layer 70.

The via holes 60*x*, 60*y*, 60*z* and 100*x* may be formed by laser processing using $CO_2$ laser or the like, for example. Each of the via holes 60*x*, 60*y* and 60*z* formed by the laser processing is a concave portion having an inverse cone trapezoid shape where the diameter of the open portion at the insulating layer 50 side is larger than the diameter of the bottom surface formed at the upper surface of the wiring layer 20 or the like. Further, each of the via holes 100*x* formed by the laser processing is a concave portion having a cone trapezoid shape where the diameter of the open portion at the insulating layer 100 side is larger than the diameter of the bottom surface formed at the lower surface of the wiring layer 70.

After the step illustrated in FIG. 5C, by forming the wiring layer 60 including the wirings 61, 62 and 63 and the wiring layer 110, the wiring board 1 as illustrated in FIG. 1A and FIG. 1B is formed. The wiring layer 60 may be formed by, first, a seed layer (not illustrated in the drawings) made of copper (Cu) or the like that continuously cover the inner walls and the bottom surfaces of the via hole 60*x*, 60*y* and 60*z* and the upper surface of the insulating layer 50 by electroless plating or sputtering. Then, a resist layer (not illustrated in the drawings) provided with an open portion corresponding to the wiring layer 60 is formed on the seed layer. Thereafter, the conductive layer (not illustrated in the drawings) made of copper (Cu) or the like is formed at the open portion of the resist layer by an electrolytic plating process using the seed layer as a power supply layer. Subsequently, after removing the resist layer, a part of the seed layer that is not covered by the conductive layer is removed by etching using the conductive layer as a mask. With this, the wiring layer 60 including the seed layer and the conductive layer is formed (semi-additive method). The wiring layer 110 may be formed by a similar method.

Figure 6A:
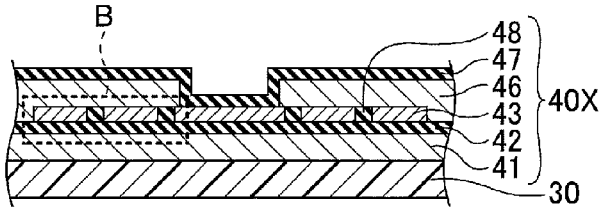
FIG. 6A and FIG. 6B are views for explaining an advantage of the wiring board of the first embodiment.
Figure 6B:
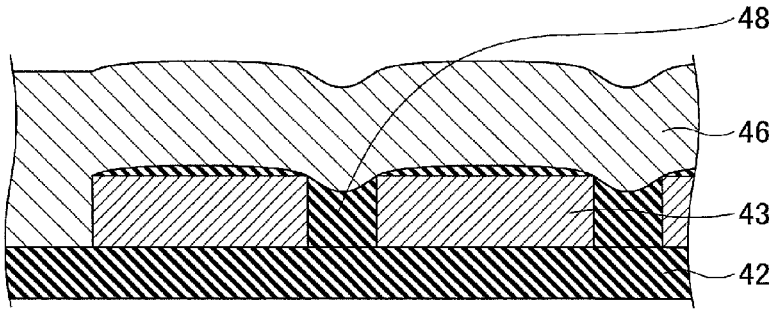

Next, a specific advantage of the wiring board 1 of the embodiment is explained. FIG. 6A and FIG. 6B are cross-sectional views for explaining the specific advantage of the wiring board 1 of the embodiment. FIG. 6B is an enlarged view of a portion "B" of FIG. 6A.

In FIG. 6A and FIG. 6B, a case is illustrated in which a coil 40X does not include the insulating layer 44 and the insulating layer 45. However, if the second magnetic layer 46 is formed in the space portions between the winding wires of the coil portion 43, the inductance of the coil 40X is lowered. In order to suppress such a problem, insulating resin 48 may be provided in the space portions between the winding wires of the coil portion 43. Then, the second magnetic layer 46 and the insulating layer 47 are formed to cover the coil portion 43 and the insulating resin 48.

In such a case, the insulating resin 48 is formed by coating and curing liquid or paste resin on the coil portion 43 including the space portions formed between the winding wires. However, as illustrated in FIG. 6B, the insulating resin 48 may be formed on a part of the upper surface of the coil portion 43 in addition to fill the space portions formed between the winding wires of the coil portion 43. Thus, it is difficult to make an upper surface (a surface at the second magnetic layer 46 side) of the insulating resin 48 a flat surface and the upper surface of the insulating resin 48 becomes an uneven surface. This is because concave portions may be formed at the upper surface of the insulating resin 48 at positions corresponding to the space portions formed between the winding wires of the coil portion 43 and there are portions on the coil portion 43 where the insulating resin 48 is formed and portions where the insulating resin 48 is not formed. The difference between the highest (thickest) portion and the lowest (thinnest) portion of the upper surface of the insulating resin 48, with respect to a surface of the insulating layer 42 at which the coil portion 43 is formed as a base, becomes about 5 to 10 μm, for example.

With this, the second magnetic layer 46 formed on the insulating resin 48 has a convexo-concave shape. This convexo-concave shape causes a bad influence on the crystallinity of the alloy of zinc and ferrite (Zn—Fe) or the like that constitutes the second magnetic layer 46 (crystal orientation becomes uneven) which deteriorates magnetic characteristics such as magnetic permeability or the like.

On the other hand, according to the coil 40 included in the wiring board 1 of the first embodiment, liquid or paste insulating resin is not used for filling the space portions generated between the winding wires of the coil portion 43. In the coil 40, the insulating layer 44 is formed to fill the space portions formed between the winding wires of the coil portion 43 and to cover the entirety of the first magnetic layer 41 and the coil portion 43. Then, the second magnetic layer 46 is formed on the insulating layer 44.

The insulating layer 44 is formed by placing a semi-cured resin film to cover the coil portion 43 and pressing the semi-cured resin film toward the insulating layer 30 side while heating. Thus, the resin film can fill the space portions formed between the winding wires of the coil portion 43 and form the insulating layer 44 whose upper surface is a flat surface. As a result, the second magnetic layer 46 formed on the insulating layer 44 does not have a convexo-concave shape. Thus, crystallinity of the alloy (Zn—Fe) of zinc and ferrite or the like that composes the second magnetic layer 46 is not influenced (crystal orientation is even), and magnetic characteristics such as magnetic permeability or the like can be improved.

The wiring board 1 of the first embodiment further has the following advantages. The wiring board 1 includes the coil 40 including the first magnetic layer 41, the coil portion 43 and the second magnetic layer 46. As the first magnetic layer 41, the coil portion 43 and the second magnetic layer 46 of the coil 40 are formed by plating processes, they are easily formed inside the wiring board 1.

Further, as the portion of the coil portion 43 other than the one end 43A and the other end 43B is covered by the first magnetic layer 41 and the second magnetic layer 46, the inductance of the coil 40 can be improved while making the size of the coil 40 small.

As the coil 40 having a high inductance can be manufactured in the wiring board 1 by the first magnetic layer 41 and the second magnetic layer 46 according to a method similar to that when manufacturing a normal wiring board, manufacturing cost of the wiring board 1 can be reduced.

As the coil portion 43 of the coil 40 is surrounded by the first magnetic layer 41 and the second magnetic layer 46 and has a high noise resistance, the influence caused by the coil portion 43 on peripheral wirings or the like can be extremely small so that peripheral circuits can be freely designed.

(Alternative Example of First Embodiment)

In an alternative example of the first embodiment, the wiring board 1 further includes an insulating layer. It is to be noted that, in the explanation of the drawings, the same components that are explained in the first embodiment are given the same reference numerals, and explanations are not repeated.

Figure 7:
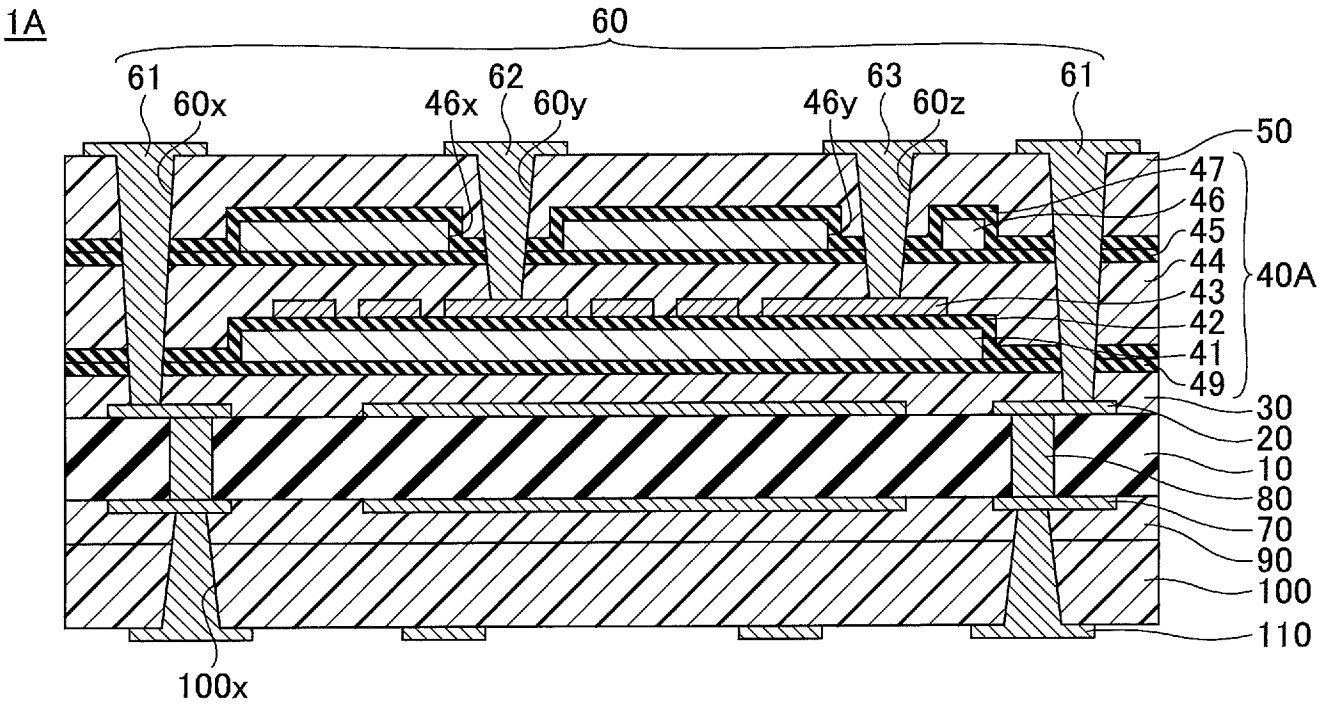
FIG. 7 is a cross-sectional view illustrating an example of a wiring board of an alternative example of the first embodiment.

FIG. 7 is a cross-sectional view illustrating an example of a wiring board of an alternative example of the first embodiment. FIG. 7 corresponds to FIG. 1A. The plan view in this alternative example is same as that illustrated in FIG. 1B.

With reference to FIG. 7, the wiring board 1A is different from the wiring board 1 (see FIG. 1A) in that the coil 40 is substituted by a coil 40A. The coil 40A further includes an insulating layer 49 in addition to the components of the coil 40. The insulating layer 49 is formed on the upper surface of the insulating layer 30. The first magnetic layer 41 and the insulating layer 42 are formed on the upper surface of the insulating layer 49. In other words, the insulating layer 49 is formed between the insulating layer 30 and the first magnetic layer 41 and the insulating layer 42. The method of forming the insulating layer 49 and the material and the thickness of the insulating layer 49 may be the same as those of the insulating layer 42. The insulating layer 49 is a typical example of the fourth insulating layer.

As such, the insulating layer 49 may be formed between the insulating layer 30 and the first magnetic layer 41. By forming the insulating layer 49 on the insulating layer 30, an upper surface of the insulating layer 49 can be more even than the upper surface of the insulating layer 30. Thus, by forming the first magnetic layer 41 on the upper surface of the insulating layer 30 via the insulating layer 49, stable crystal orientation can be easily obtained in the first magnetic layer 41. Further, the thickness of the first magnetic layer 41 can be easily controlled and the thickness of the first magnetic layer 41 can be made more even.

According to the embodiment, a wiring board or the like including a small size coil is provided.

Although a preferred embodiment of the wiring board and the method of manufacturing the wiring board has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

For example, in the above embodiment and the alternative example, an example is explained in which the wiring board 1 is a build-up wiring board. However, the wiring board 1 is not limited to the build-up wiring board. The wiring board 1 may be any kinds of board as long as having a structure in which the insulating layers and the wiring layers are stacked.

Further, in the above embodiment and the alternative example, an example is explained in which the wiring board 1 is a build-up wiring board including a so-called core substrate. However, the wiring board 1 may be a so-called coreless build-up wiring board that does not include the core substrate.

Further, in the above embodiment and the alternative example, an example is explained in which the one end 43A and the other end 43B of the coil 40 are connected to the wirings 62 and 63 that are positioned at an upper part of the wiring board 1. However, the one end 43A and the other end 43B may not be connected to the wirings positioned at an upper part of the wiring board 1. For example, at least one of the one end 43A and the other end 43B may be drawn in a lateral direction of the wiring board 1 via a wiring layer.

Further, in the above embodiment and the alternative example, an example is explained in which the first magnetic layer 41 that is larger than the coil portion 43 in a plan view is positioned at the lower surface side of the coil portion 43 of the coil 40 and the second magnetic layer 46 that covers the part of the coil portion 43 other than the one end 43A and the other end 43B is provided at the upper surface side of the coil portion 43. However, the second magnetic layer 46 may be formed to expose the part of the coil portion 43 other than the one end 43A and the other end 43B. Further, the first magnetic layer 41 may be formed to expose a part of the lower surface of the coil portion 43. For example, in a case that a sufficient space for forming the first magnetic layer 41 and the second magnetic layer 46 cannot be obtained due to other wirings or the like, a part of the coil portion 43 may not be covered by the first magnetic layer 41 and the second magnetic layer 46 and may be exposed.

What is claimed is:

1. A wiring board comprising:

a plurality of insulating layers;

a plurality of wiring layers;

a through via provided to penetrate at least one of the insulating layers to electrically connect the wiring layers that are provided to interpose the at least one of the insulating layers therebetween;

a first insulating layer, which is one of the insulating layers; and a coil formed on the first insulating layer and including a first magnetic layer formed on the first insulating layer and formed by a plating layer to form a first convexo-concave shape on the first insulating layer, a coil portion formed on the first magnetic layer to form a second convexo-concave shape on the first magnetic layer, a second insulating layer, which is one of the insulating layers, formed on the first insulating layer to cover the first magnetic layer and the coil portion so as to absorb the first convexo-concave shape and the second convexo-concave shape generated by the first magnetic layer and the coil portion, respectively, an upper surface of the second insulating layer being a flat surface that is flat with respect to the first insulating layer, and a second magnetic layer formed on the second insulating layer and formed by a plating layer, the second magnetic layer being formed to extend only in a direction that is parallel to the upper surface of the second insulating layer, wherein the second insulating layer is formed to cover the entirety of the first magnetic layer including side surfaces and an upper surface of the first magnetic layer.

2. The wiring board according to claim 1, wherein the coil further includes a third insulating layer formed on the second insulating layer, and the second magnetic layer is formed on an upper surface side of the second insulating layer via the third insulating layer, wherein the thickness of the third insulating layer is thinner than the thickness of the second insulating layer, and wherein the upper surface of the third insulating layer is more even than the upper surface of the second insulating layer.

3. The wiring board according to claim 1, wherein the second insulating layer is formed by resin.

4. The wiring board according to claim 3, wherein the resin includes magnetic filler.

5. The wiring board according to claim 1, wherein the coil portion is fanned by a plating layer.

6. The wiring board according to claim 1, wherein the coil includes a fourth insulating layer formed between the first insulating layer and the first magnetic layer, wherein the thickness of the fourth insulating layer is thinner than the thickness of the first insulating layer, and wherein the upper surface of the fourth insulating layer is more even than the upper surface of the first insulating layer.

7. The wiring board according to claim 1, further comprising a sixth insulating layer that continuously covers an upper surface and side surfaces of the first magnetic layer, and an upper surface of the first insulating layer, wherein the coil portion is provided on the first magnetic layer via the sixth insulating layer, wherein the second insulating layer is provided on the first insulating layer and the first magnetic layer via the sixth insulating layer, and wherein the thickness of the sixth insulating layer is thinner than the thickness of the second insulating layer.

8. A wiring board comprising:

a plurality of insulating layers;

a plurality of wiring layers;

a through via provided to penetrate at least one of the insulating layers to electrically connect the wiring layers that are provided to interpose the at least one of the insulating layers therebetween;

a first insulating layer, which is one of the insulating layers;

a coil formed on the first insulating layer and including a first magnetic layer formed on the first insulating layer and formed by a plating layer to form a first convexo-concave shape on the first insulating layer, a coil portion formed on the first magnetic layer to form a second convexo-concave shape on the first magnetic layer, a second insulating layer, which is one of the insulating layers, formed on the first insulating layer to cover the first magnetic layer and the coil portion by embedding the first convexo-concave shape and the second convexo-concave shape generated by the first magnetic layer and the coil portion, respectively, an upper surface of the second insulating layer being a flat surface that is flat with respect to the first insulating layer, and a second magnetic layer formed on the second insulating layer and formed by a plating layer;

a fifth insulating layer formed on the second insulating layer to cover the second magnetic layer;

a wiring formed on an upper surface of the fifth insulating layer; and a via wiring formed to penetrate the fifth insulating layer and the second insulating layer to electrically connect the wiring and the coil portion, wherein the second insulating layer is formed to cover the entirety of the first magnetic layer including side surfaces and an upper surface of the first magnetic layer.

9. The wiring board according to claim 8, wherein the coil further includes a third insulating layer formed on the second insulating layer, and the second magnetic layer is formed on an upper surface side of the second insulating layer via the third insulating layer, wherein the thickness of the third insulating layer is thinner than the thickness of the second insulating layer, and wherein the upper surface of the third insulating layer is more even than the upper surface of the second insulating layer.

10. The wiring board according to claim 8, wherein the second insulating layer is formed by resin.

11. The wiring board according to claim 10, wherein the resin includes magnetic filler.

12. The wiring board according to claim 8, wherein the coil portion is formed by a plating layer.

13. The wiring board according to claim 8, wherein the coil includes a fourth insulating layer formed between the first insulating layer and the first magnetic layer, wherein the thickness of the fourth insulating layer is thinner than the thickness of the first insulating layer, and wherein the upper surface of the fourth insulating layer is more even than the upper surface of the first insulating layer.

14. The wiring board according to claim 8, wherein the second magnetic layer is provided with an open portion and the via wiring is formed to penetrate within the open portion.

15. The wiring board according to claim 14, wherein the open portion is provided to overlap one end of the coil portion such that the via wiring is connected to the one end of the coil portion.

16. The wiring board according to claim 8, further comprising a sixth insulating layer that continuously covers an upper surface and side surfaces of the first magnetic layer, and an upper surface of the first insulating layer, wherein the coil portion is provided on the first magnetic layer via the sixth insulating layer, wherein the second insulating layer is provided on the first insulating layer and the first magnetic layer via the sixth insulating layer, and wherein the thickness of the sixth insulating layer is thinner than the thickness of the second insulating layer.

17. The wiring board according to claim 8, further comprising:

a second wiring, which is one of the wiring layers, on which the first insulating layer is formed;

a second via wiring formed to penetrate the fifth insulating layer, the second insulating layer and the first insulating layer, wherein the second via wiring is electrically connected to the second wiring.

* * * * *